US009041507B2

(12) United States Patent
Wang et al.

(10) Patent No.: US 9,041,507 B2
(45) Date of Patent: May 26, 2015

(54) SURFACE MOUNTABLE OVER-CURRENT PROTECTION DEVICE

(71) Applicant: POLYTRONICS TECHNOLOGY CORP., Hsinchu (TW)

(72) Inventors: David Shau Chew Wang, Taipei (TW); Wen Feng Lee, Taoyuan (TW); En Tien Yang, Taipei (TW); Chun Teng Tseng, Miaoli (TW); Yi An Sha, New Taipei (TW)

(73) Assignee: POLYTRONICS TECHNOLOGY CORP., Hsinchu (TW)

( * ) Notice: Subject to any disclaimer, the term of this patent is extended or adjusted under 35 U.S.C. 154(b) by 251 days.

(21) Appl. No.: 13/910,916

(22) Filed: Jun. 5, 2013

(65) Prior Publication Data

US 2014/0146432 A1 May 29, 2014

(30) Foreign Application Priority Data

Nov. 29, 2012 (TW) ..... 101144921 A

(51) Int. Cl.
*H01C 7/10* (2006.01)
*H01C 7/02* (2006.01)

(52) U.S. Cl.
CPC ..... *H01C 7/027* (2013.01); *H01C 7/021* (2013.01)

(58) Field of Classification Search
CPC .... H01C 7/027; H01C 17/06586; H01C 7/12; H01C 7/13; H01C 17/06553; H01C 10/103; H01C 10/106; H01C 1/1406; H01C 7/021; H01C 7/105; H01C 17/06513; H01C 17/0656; H01C 7/02; H01C 7/18; H01C 1/08
USPC ..... 338/22 R, 13
See application file for complete search history.

(56) References Cited

U.S. PATENT DOCUMENTS

| | | | | |
|---|---|---|---|---|
| 5,985,976 | A * | 11/1999 | Wartenberg et al. | 524/495 |
| 6,104,587 | A * | 8/2000 | Banich et al. | 361/106 |
| 7,382,224 | B2 * | 6/2008 | Wang et al. | 338/22 R |
| 8,536,973 | B2 * | 9/2013 | Lo et al. | 338/22 R |
| 2007/0024412 | A1 * | 2/2007 | Wang et al. | 338/22 R |
| 2009/0045908 | A1 * | 2/2009 | Tanaka et al. | 338/25 |

* cited by examiner

*Primary Examiner* — Kyung Lee
(74) *Attorney, Agent, or Firm* — Shimokaji IP

(57) ABSTRACT

A surface mountable over-current protection device comprises one PTC material layer, first and second conductive layers, first and second electrodes, and an insulating layer. The PTC material layer comprises crystalline polymer and conductive filler dispersed therein. The first and second conductive layers are disposed on first and second planar surfaces of the PTC material layer, respectively. The first and second electrodes are electrically connected to the first and second conductive layers. The insulating layer is disposed between the first and the second electrodes for insulation. At the melting point of the crystalline polymer, the CTE of the crystalline polymer is greater than 100 times the CTE of the first or second conductive layer, and the first and/or second conductive layers has a thickness which is large enough to obtain a resistance jump value R3/Ri less than 1.4.

16 Claims, 5 Drawing Sheets

SURFACE MOUNTABLE OVER-CURRENT PROTECTION DEVICE

BACKGROUND OF THE INVENTION (1) Field of the Invention

The present application relates to a surface-mountable over-current protection device, and more particularly to a surface-mountable over-current protection device with superior resistance repeatability.

(2) Description of the Related Art

Because the resistance of conductive composite materials having positive temperature coefficient (PTC) characteristic is very sensitive to temperature variation, it can be used as the material for current sensing devices, and has been widely applied to over-current protection devices or circuit devices. The resistance of the PTC conductive composite material remains extremely low at normal temperature, so that the circuit or cell can operate normally. However, when an over-current or an over-temperature event occurs in the circuit or cell, the resistance instantaneously increases to a high resistance state (e.g., at least $10^2\Omega$), so as to suppress over-current and protect the cell or the circuit device.

A known PTC material usually uses carbon black as conductive filler which is evenly dispersed in crystalline polymer. In this crystalline structure, the carbon black particles are usually aligned at grain boundaries and are arranged closely. Accordingly, current can flow through the insulating crystalline polymer through such "carbon black chains." At normal temperatures such as room temperature, numerous carbon chains exist in the polymer and constitute conductive paths.

When the current make the device temperature increase to a temperature exceeding the phase transition temperature such as the melting point of the polymer, the polymer expands to change the crystalline state to amorphous state. As such, the carbon chains are broken and thus current is not allowed to pass therethrough, and as a consequence the resistance increases tremendously. The phenomenon of instant increase of resistance is the so-called "trip."

When the temperature decreases to below the phase transition temperature, the polymer is re-crystallized and the carbon black chains are rebuilt. However, the polymer cannot be fully recovered after expansion so that the carbon chains cannot sustain original conductivity and the resistance cannot return to initial low resistance. After tripping many times, the resistance may increase significantly, resulting in poor resistance recovery or poor resistance repeatability.

SUMMARY OF THE INVENTION

The present application relates to a surface-mountable over-current protection device in which the PTC material can restrict or avoid extreme expansion, so as to obtain superior resistance recovery or resistance repeatability.

When tripping, the volume of the PTC polymer changes tremendously, and the coefficient of thermal expansion (CTE) may be over 5000 ppm/K. After tripping many times, the resistance of the PTC device increases significantly. In a surface-mountable PTC device, the conductive layers in physical contact with the PTC material layer are usually metal foils such as nickel foils, copper foils or nickel-plated copper foils. The CTE of the copper foil or nickel-plated copper foil are about 17 ppm/K, and the CTE of the nickel foil is 13 ppm/K, both are much smaller than that of the PTC polymer material. The conductive layers are usually overlaid by insulating layers containing epoxy resin and fiber glass such as prepreg FR-4. At a temperature lower than the glass transition temperature, the CTE in z-axis of FR-4 is larger than about 60 ppm/K. At a temperature larger than the glass transition temperature, the CTE in z-axis of FR-4 is larger than about 310 ppm/K. It can be noted that the CTE of the PTC polymer is significantly different from those of the conductive layers and the insulating layers. According to the present application, the volume and resistance recoveries of the PTC polymer are improved by taking advantage of the difference of the CTEs.

According to an embodiment of the present application, a surface-mountable over-current protection device comprises at least one PTC material layer, a first conductive layer, a second conductive layer, a first electrode, a second electrode and at least one insulating layer. The PTC material layer has opposite first and second planar surfaces, and comprises crystalline polymer and conductive filler dispersed therein. The first conductive layer is disposed on the first planar surface, and the second conductive layer is disposed on the second planar surface. In other words, the PTC material layer is disposed between the first and second conductive layers. The first electrode electrically connects to the first conductive layer, whereas the second electrode electrically connects to the second conductive layer. The insulating layer is disposed between the first and second electrodes to electrically isolate the first electrode from the second electrode. The crystalline polymer has a melting temperature at which the CTE of the crystalline polymer is larger than 100 times of the CTE of first and/or second conductive layer. At least one of the first and second conductive layers has a thickness sufficient to obtain a resistance jump R3/Ri of the over-current protection device less than 1.4, where Ri is an initial resistance, and R3 is a resistance after tripping three times.

According to an embodiment, at least one of the first and second conductive layers has a thickness ranging from 38 μm to 200 μm. The conductive layers are thicker than traditional ones to avoid excessive expansion of the PTC material layer that is harmful to resistance recovery.

By increasing the thickness or the strength of the conductive layer, the conductive layer of low CTE can effectively restrict or mitigate the expansion of the PTC material layer contacted thereon so as to improve the resistance repeatability.

BRIEF DESCRIPTION OF THE DRAWINGS

The present application will be described according to the appended drawings in which.

DETAILED DESCRIPTION OF THE INVENTION

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

Figure 1:
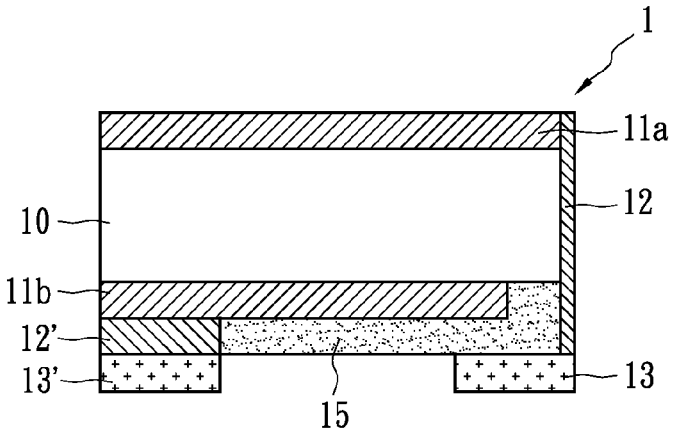
FIGS. 1 to 8 show surface-mountable over-current protection devices in accordance with first to eight embodiments of the present application.

FIG. 1 illustrates a surface-mountable over-current protection device 1 in accordance with a first embodiment of the present application, which is suitable to adhere to a substrate or a circuit board (not shown). A first electrode 13 and a second electrode 13' corresponding to the first electrode 13 are usually located on a same plane. The surface-mountable over-current protection device 1 can be designed to contain only one electrode set comprising the first electrode 13 and the second electrode 13' such that only one surface thereof could adhere to the substrate. The design in FIG. 1 is usually applied to a narrow space and meets the requirements of one-way heat conduction or one-way heat insulation. In the embodiment, the first electrode 13, a connecting conductor 12, a first conductive layer 11*a*, a PTC material layer 10, a second conductive layer 11*b*, a connecting conductor 12', and the second electrode 13' form a conductive circuit to connect an external device (not shown) and a power source (not shown). In addition, an insulating layer 15 is disposed between the first electrode 13 and second electrode 13' to electrically insulate the first electrode 13 from the second electrode 13'. The connecting conductor 12 may be conductive plated through hole or wrap-around conductive side surface.

Figure 2:
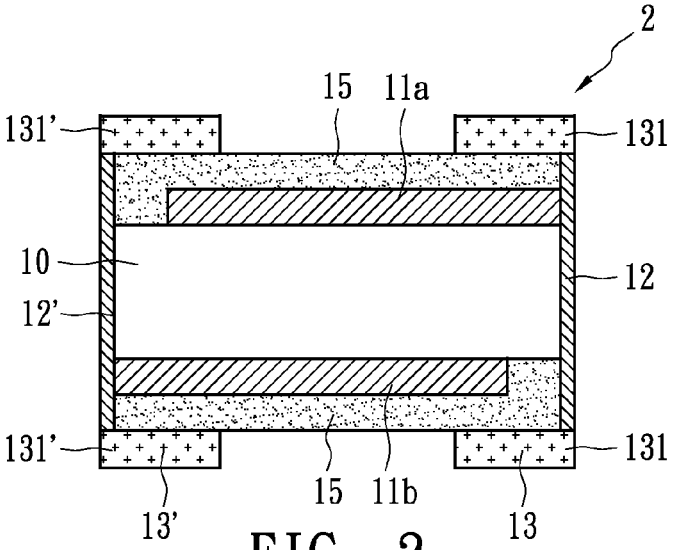

FIG. 2 illustrates a surface-mountable over-current protection device 2 in accordance with a second embodiment of the present application, which is designed to contain two electrode sets, each comprising the first electrode 13 and the second electrode 13' on the top surface thereof and the bottom surface thereof, respectively. Thus, the first and second electrodes 13 and 13' form a positive electrode and a negative electrode at the top surface and the bottom surface of the surface-mountable over-current protection device 2 such that either of the top and the bottom surfaces could be used to adhere to the substrate or circuit board. Therefore, there is no up-down direction concern in the design, and the manufacturing process (e.g., the selection of resistors, device packaging, device assembly and the manufacturing process of the printed circuit board) is simplified Similar to the first embodiment, the second embodiment employs insulating layers 15 to electrically insulate the first electrode 13 from the second electrode 13'. More specifically, the first conductive layer 11*a* and the second conductive layer 11*b* are disposed on the upper and the lower surfaces of the PTC material layer 10, respectively. In other words, the PTC material layer 10 is disposed between the first and second conductive layers 11*a* and 11*b*. The first electrode 13 comprises a pair of first electrode layers 131 at the upper and lower surfaces of the device 2, and the second electrode 13' comprises a pair of second electrode layers 131' at the upper and lower surfaces of the device 2. The first electrode layers 131 and the second electrode layers 131' are formed on the insulating layers 15. The first connecting conductor 12 connects to the pair of first electrode layers 131 and the first conductive layer 11*a*, whereas the second connecting conductor 12' connects to the pair of second electrode layers 131' and the second conductive layer 11*b*. The PTC material layer 10, the first conductive layer 11*a*, the second conductive layer 11*b*, the first electrode 13 and the second electrode 13' are laminated. The first conductive layer 11*a* is viewed as an inner circuit in comparison with adjacent first electrode 13 and the second electrode 13', i.e., the upper electrode layers 131 and 131'. Likewise, the second conductive layer 11*b* is viewed as an inner circuit in comparison with adjacent second electrode 13 and the second electrode 13', i.e., the lower electrode layers 131 and 131'.

Figure 3:
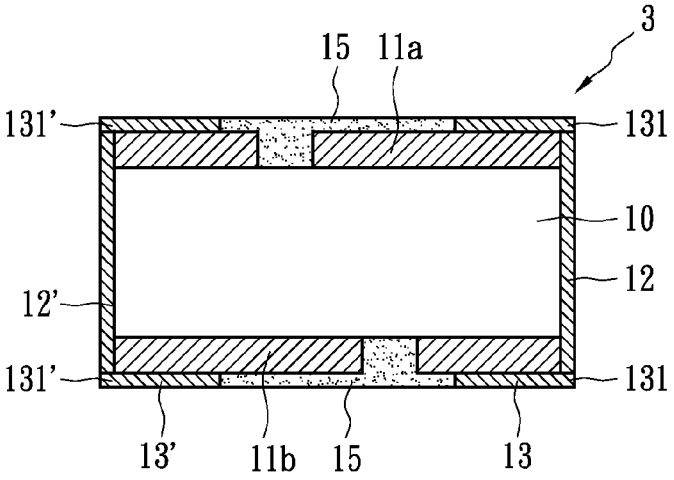

FIG. 3 illustrates a surface-mountable over-current protection device 3 in accordance with a third embodiment of the present application, in which the first connecting conductor 12 and the second connecting conductor 12' may be formed by metallic electroplating on side surfaces of the surface-mountable over-current protection device 3 to form wrap-around electrical conductors. The first connecting conductor 12 connects to the first conductive layer 11*a* and the pair of first electrode layers 131, and the second connecting conductor 12' connects to the second conductor layer 11*b* and the pair of the second electrode layers 131'. In this embodiment, the upper first electrode layer 131 is in physical contact with the first conductive layer 11*a*, whereas the lower second electrode layer 131' is in physical contact with the second conductive layer 11*b*. In addition, the first and the second connecting conductors 12 and 12' may connect to the first and the second conductive layers 11*a* and 11*b* and electrodes 13 and 13' by soldering, electroplating and reflowing, or curing. In the current embodiment, the first and the second connecting conductors 12 and 12' can be formed by first forming micro holes, followed by electroplating the holes to form plating-through-holes or metal filling process to form conductive posts.

Figure 4:
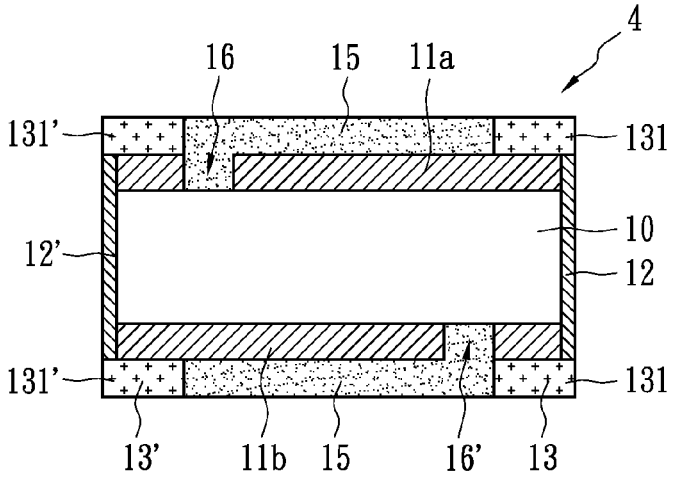

FIG. 4 illustrates a surface-mountable over-current protection device 4 in accordance with a fourth embodiment of the present application. The first electrode 13 comprises a pair of first electrode layers 131, and the second electrode 13' comprises a pair of second electrode layers 131'. A first connecting conductor 12 connects to the pair of the first electrode layers 131 and the first conductive layer 11*a*, whereas a second connecting conductor 12' connects to the pair of the second electrode layers 131' and the second conductive layer 11*b*. The first conductive layer 11*a* is formed by etching and is electrically insulated from the second electrode 13' and the second connecting conductor 12' by an etching line or etching area 16. Similarly, the second conductive layer 11*b* is formed by etching and is electrically insulated from the first electrode 13 and the first connecting conductor 12 by an etching line or etching area 16'.

Figure 5:
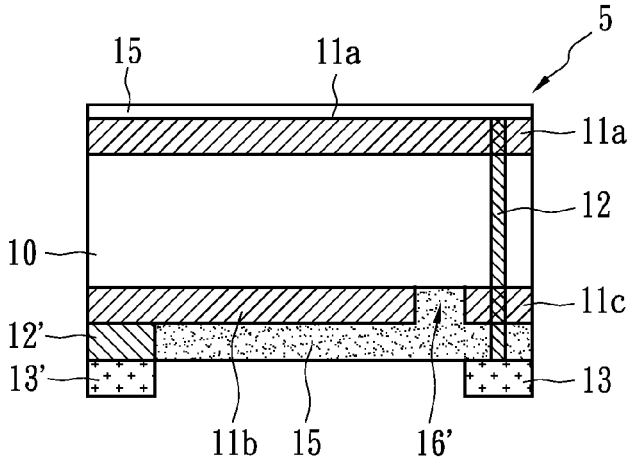

FIG. 5 illustrates a surface-mountable over-current protection device 5 in accordance with a fifth embodiment of the present application. Like the device 1 shown in FIG. 1, the device 5 relates to a SMD-type over-current protection device with a single-side electrode. The first connecting conductor 12, e.g., a conductive plated-through-hole or conductive post, electrically connects to a first conductive layer 11*a*, a third conductive layer 11*c* and a first electrode 13. The third conductive layer 11*c* is formed by etching and is electrically insulated from the second conductive layer 11*b* by an etching line or etching area 16'. More specifically, the third conductive layer 11*c*, which adheres to the PTC material layer 10, and the second conductive layer 11*b* are located on a same plane. In an embodiment, the first conductive layer 11*a* is overlaid by a thin insulating layer 15 such as insulating paint or text ink.

Figure 6:
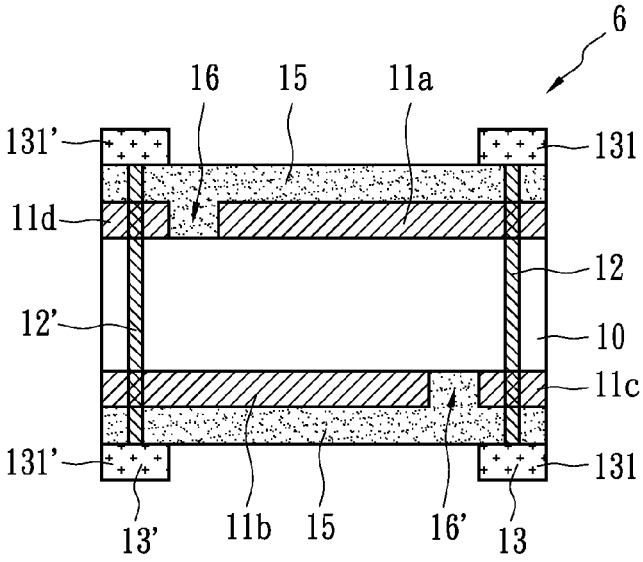

FIG. 6 illustrates a surface-mountable over-current protection device 6 in accordance with a sixth embodiment of the present application. The first electrode 13 comprises a pair of first electrode layers 131 at the upper and lower surfaces of the device 6, and the second electrode 13' comprises a pair of second electrode layers 131' at the upper and lower surfaces of the device 6. A first connecting conductor 12, e.g., a conductive plated-through-hole or a conductive post, electrically connects to the first electrode layer 131, a first conductive layer 11*a* and a third conductive layer 11*c*. The third conductive layer 11*c* is formed by etching and is electrically insulated from a second conductive layer 11*b* by an etching line or etching area 16'. A second connecting conductor 12', e.g., a conductive plated-through-hole or a conductive post, electrically connects to the second electrode layer 131', a second conductive layer 11*b* and a fourth conductive layer 11*d*. The fourth conductive layer 11*d* is formed by etching and is electrically insulated from a first conductive layer 11*a* by an etching line or etching area 16. The fourth conductive layer 11*d* adheres to the PTC material layer 10, and the first and fourth conductive layers 11*a* and 11*d* are on a same plane.

Figure 7:
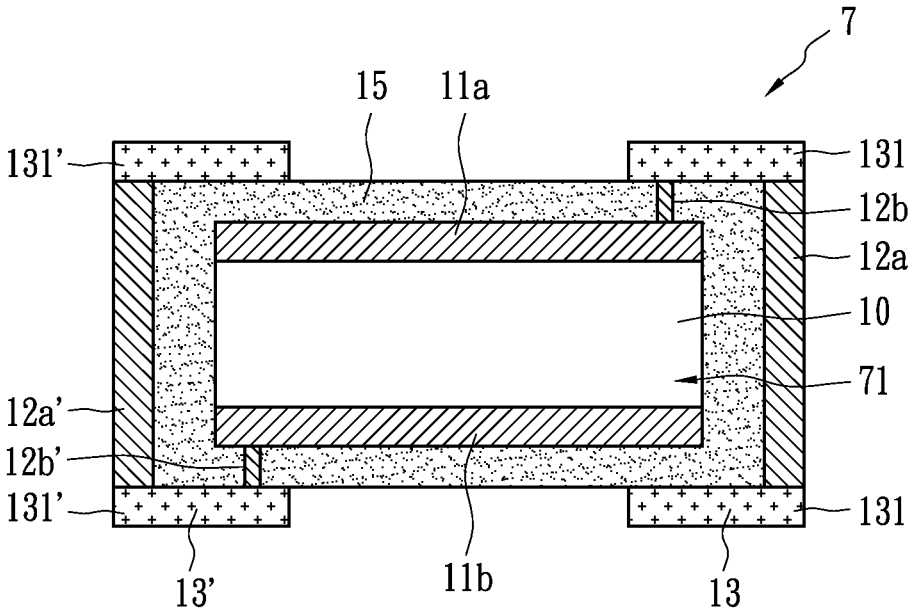

FIG. 7 illustrates a surface-mountable over-current protection device 7 in accordance with a seventh embodiment of the present application. The over-current protection device 7 comprises a PTC device 71, a first connecting conductor 12*a*, a second connecting conductor 12*a*', a first electrode 13 and a second electrode 13'. The PTC device 71 comprises a first conductive layer 11*a*, a second conductive layer 11*b* and a PTC material layer 10 laminated therebetween. The first electrode 13 comprises a pair of first electrode layers 131 at the upper and lower surfaces of the device 7, and the second electrode 13' comprises a pair of second electrode layers 131' at the upper and lower surfaces of the device 7. An insulating layer 15 encompasses the PTC device 7. The connecting conductor 12*a*, e.g., a conductive plated-through-hole or a conductive side surface, connects to the pair of first electrode layers 131. The connecting conductor 12*b*, e.g., a conductive plated-through-hole or a conductive post, connects to conductive layer 11*a* and the upper electrode layer 131. The connecting conductor 12*a*', e.g., a conductive plated-through-hole or a conductive side surface, connects to the pair of second electrode layers 131'. The connecting conductor 12*b*', e.g., a conductive-through-hole or a conductive post, connects to conductive layer 11*b* and the lower electrode layer 131'.

Figure 8:
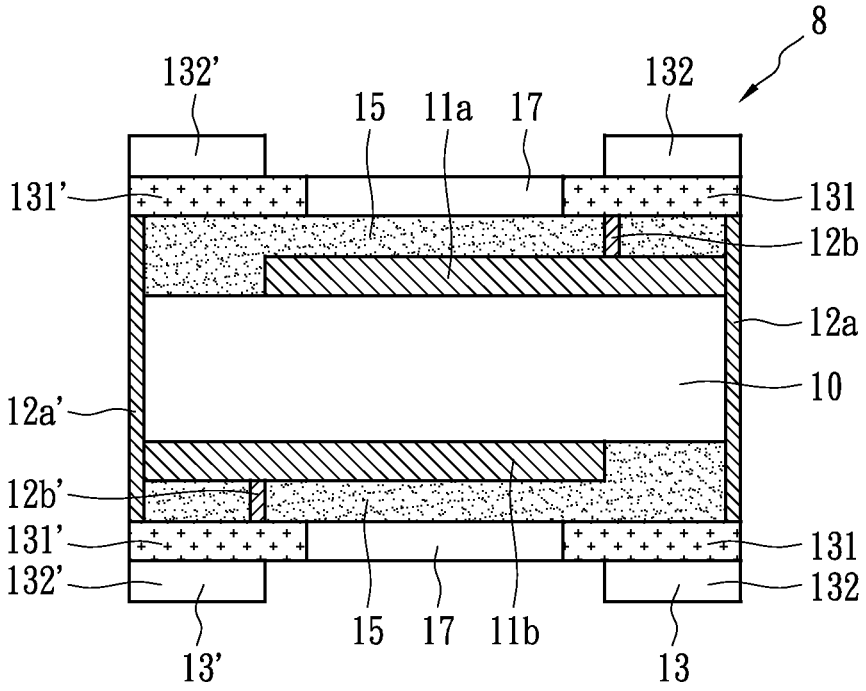

FIG. 8 illustrates a surface-mountable over-current protection device 8 in accordance with an eighth embodiment of the present application. The device 8 is similar to the structure shown in FIG. 2 except the device 8 further comprises a connecting conductor 12*b* connecting to the upper electrode layer 131 and the first conductive layer 11*a*, and a connecting conductor 12*b*' connecting to the lower electrode layer 131' and the second conductive layer 11*b*, thereby increasing heat transfer or heat dissipation efficiency. Moreover, if the electrode layers 131 and 131' are copper layers, they may be preferably combined with tin layers 132 and 132' for easy soldering. A solder mask 17 may be formed between the first electrode layer 131 and the second electrode layer 131' at the upper or lower surface.

An exemplary manufacturing process of the surface-mountable over-current protection device is described below. The people having ordinary knowledge can apply equivalent or similar processes to the aforesaid surface-mountable over-current protection devices or the like.

The manufacturing of the surface-mountable over-current protection device of the present invention is given as follows. The raw material is set into a blender (Haake-600) at 160° C. for 2 minutes. The procedures of feeding the material are as follows: The crystalline polymer with a certain amount is first loaded into the Haake blender till the polymer is fully melted. The conductive fillers (e.g., nickel powder, titanium carbide, tungsten carbide or carbon black) and/or the non-conductive fillers (e.g., magnesium hydroxide) are then added into the blender. The rotational speed of the blender is set to 40 rpm. After blending for three minutes, the rotational speed increases to 70 rpm. After blending for seven minutes, the mixture in the blender is drained and thereby forming a conductive composition with a positive temperature coefficient behavior. Afterwards, the above conductive composition is loaded into a mold to form a symmetrical PTC lamination structure with the following layers: steel plate/Teflon cloth/PTC compound (i.e., the conductive composition)/Teflon cloth/steel plate. First, the mold loaded with the conductive composition is pre-pressed for 3 minutes at 50 kg/cm$^2$ and 160° C. This pre-press process can exhaust the gas generated from vaporized moisture or from some volatile ingredients in the PTC lamination structure. The pre-press process could also drive the air pockets out from the PTC lamination structure. As the generated gas is exhausted, the mold is pressed for additional 3 minutes at 100 kg/cm$^2$ and 160° C. After that, the press step is repeated once at 150 kg/cm$^2$, 160° C. for 3 minutes to form a PTC composite material layer.

Figure 9A:
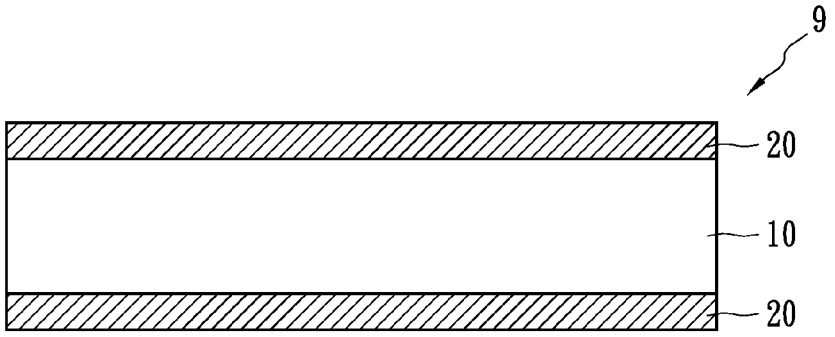
FIGS. 9A to 9C show a process of making the over-current protection device in accordance with an embodiment of the present application.

Referring to FIG. 9A, the PTC composite material layer is cut to form plural PTC material layers 10, each with a size of 20×20 cm$^2$, and two metal foils 20 physically contact the top surface and the bottom surface of the PTC material layer 10, in which the two metal foils 20 are symmetrically placed upon the top surface and the bottom surface of the PTC material layer 10. Each metal foil 20 may have a rough surface with plural nodules (not shown) to physically contact the PTC material layer 10. The metal foil 20 may have two smooth surfaces, but it usually contains one rough surface and one smooth surface in which the rough surface having nodules is in physical contact with the PTC material layer 10. Next, two Teflon cloths (not shown) are placed upon the two metal foils 20, and two steel plates (not shown) are placed upon the two Teflon cloths. All the Teflon cloths and the steel plates are disposed symmetrically on the top and the bottom surfaces of the PTC material layer 10 to form a multi-layered structure. The multi-layered structure is then pressed for 3 minutes at 60 kg/cm$^2$ and 180° C., and is then pressed at the same pressure at room temperature for 5 minutes. After the steps of pressing, the multi-layered structure is subjected to a gamma-ray radiation of 50 KGy to form a conductive composite module 9, as shown in FIG. 9A.

Figure 9B:
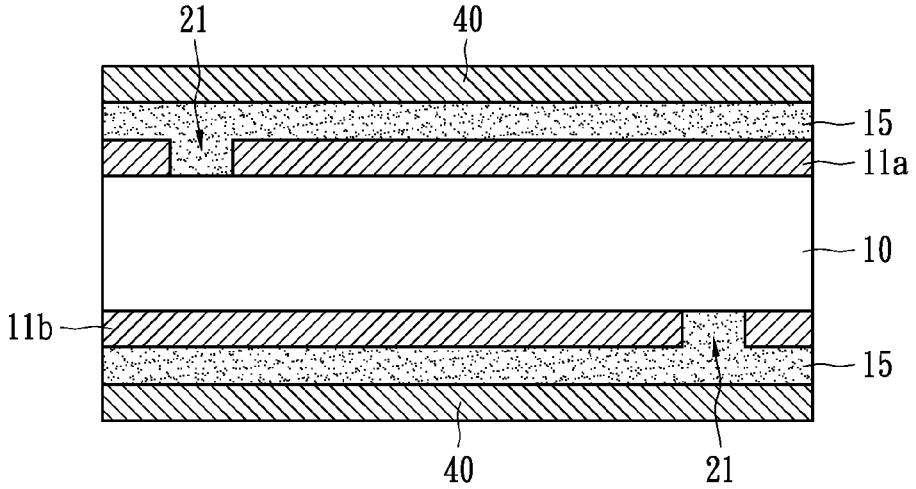

In an embodiment, the metal foils 20 of the above conductive composite module 9 are etched to form two etching lines 21 (refer to FIG. 9B) to form a first conductive layer 11*a* on a surface of the PTC material layer 10 and a second conductive layer 11*b* on another surface of the PTC material layer 10. Then, insulating layers 15, which may contain the epoxy resin of glass fiber, are disposed on the first and the second conductive layers 11*a* and 11*b*, and then copper foils 40 are formed thereon. Again, a hot-press is performed at 60 kg/cm$^2$ and 180° C. for 30 minutes so as to form a composite material layer comprising one PTC material layer 10 as shown in FIG. 9B.

Figure 9C:
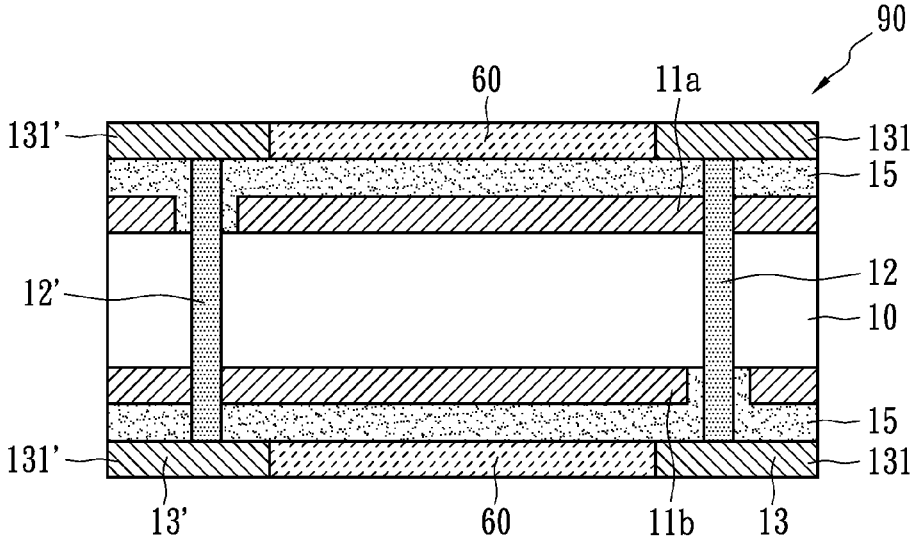

Referring to FIG. 9C, the upper and lower copper foils 40 are etched to form a pair of first electrode layers 131 and a pair of second electrode layers 131' corresponding to the first electrode layers 131. A first connecting conductor 12 and a second connecting conductor 12' are formed by drilling holes and electroplating to form plating-through-holes (PTH). The first electrode 13 comprises the pair of the first electrode layers 131, whereas the second electrode 13' comprises the pair of the second electrode layers 131'. The first connecting conductor 12 electrically connects the first conductive layer 11*a* and the first electrode layers 131, and the second connecting conductor 12' electrically connects the second conductive layer 11*b* and the second electrode layers 131'. Subsequently, insulating layers 60 or the so-called solder masks containing UV-light-curing paint are disposed between the first electrode 13 and the second electrode 13' for insulation, thereby forming a PTC plate. After curing by UV light, the PTC plate is cut according to the size of the device, so as to form SMD over-current protection devices 90.

In addition to the example comprising a single PTC material layer 10, the present application comprises other embodiments containing more PTC material layers 10.

Figure 10:
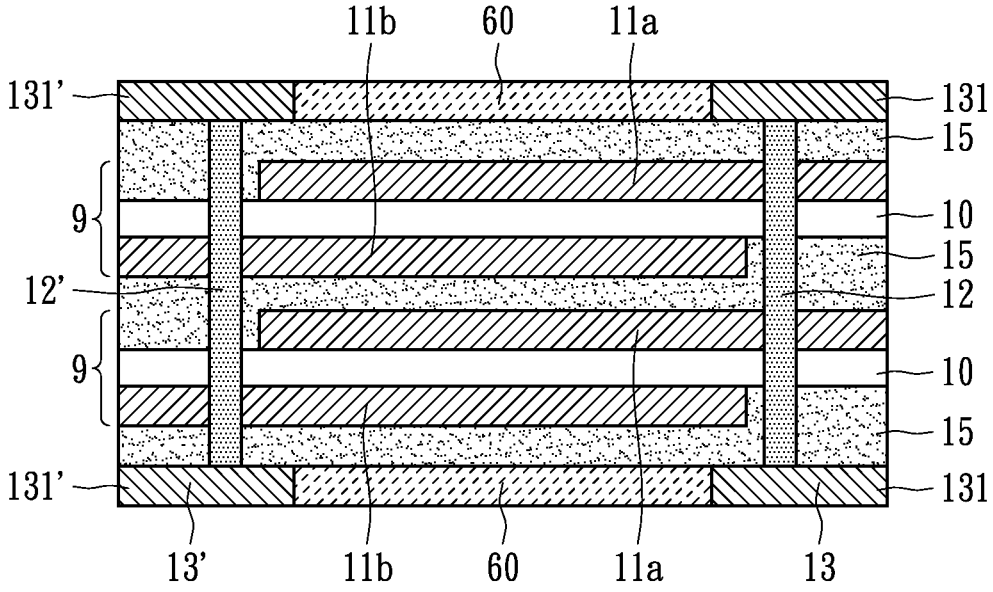
FIG. 10 shows a surface-mountable over-current protection device having two PTC material layers in accordance with another embodiment of the present application.

FIG. 10 illustrates a surface mountable over-current protection device comprising two PTC material layers 10. The manufacturing method is given as follows. Two conductive composite modules 9 are provided first. Second, the conductive layers 11*a* and 11*b* of each conductive composite module 9 are etched to form etching lines. Third, insulating layers 15, which may use the epoxy resin containing glass fiber, are disposed on the conductive layers 11*a* and 11*b* and between the two conductive composite modules 9. Then, a copper foil is placed on the top surface of the upper insulating layer 15 and another copper foil is disposed on the bottom surface of the lower insulating layer 15, followed by hot pressing at 60 kg/cm$^2$ and 180° C. for 30 minutes. After cooling, a multi-layered composite material layer comprising two PTC material layers 10 is formed. Next, the copper foils on the insulating layers 15 are etched to from a pair of first electrode layers 131 and a pair of second electrode layers 131' corresponding to the first electrode layers 131. The first electrode 13 comprises the pair of the first electrode layers 131, and the second electrode 13' comprises the pair of the second electrode layers 131'. After that, connecting conductors 12 and 12', e.g., plating-through-holes, are formed, in which the connecting conductor 12 electrically connects to the conductive layers 11*a* of the conductive composite modules 9 and the first electrode layers 131, and the second connecting conductor 12' electrically connects to the conductive layers 11*b* of the conductive composite modules 9 and the second electrode layers 131'. Afterward, insulating layers or solder masks 60, e.g., UV-light-curing paint, are disposed between the first electrodes 13 and the second electrodes 13' for insulation, thereby forming a multi-layer PTC plate. After UV-curing, the multi-layer PTC plate is cut according to the size of the device to form the SMD over-current protection device comprising multiple PTC material layers 10 or multiple PTC devices 9.

The PTC material layer 10 comprises crystalline polymer and conductive filler dispersed therein. The crystalline polymer may be polyolefins (e.g., high-density polyethylene (HDPE), medium-density polyethylene, low-density polyethylene (LDPE), polyvinyl wax, vinyl polymer, polypropylene, polyvinyl chlorine and polyvinyl fluoride), copolymer of olefin monomer and acrylic monomer (e.g., copolymer of ethylene and acrylic acid or copolymer of ethylene and acrylic resin) or copolymer of olefin monomer and vinyl alcohol monomer (e.g., copolymer of ethylene and vinyl alcohol), and may include one or more crystalline polymer materials.

In the application of over-charge protection to lithium-ion batteries, to achieve protection at low temperature, a general PTC over-current protection device must trip at a lower temperature. Therefore, the PTC material layer used in the surface mountable over-current protection device of the present application contains a crystalline polymer with a lower melting point (e.g., LDPE), or can use one or more crystalline polymers in which at least one crystalline polymer has a melting point below 115° C. The above LDPE can be polymerized using Ziegler-Natta catalyst, Metallocene catalyst or other catalysts, or can be copolymerized by vinyl monomer or other monomers such as butane, hexane, octene, acrylic acid, or vinyl acetate. Sometimes, to achieve protection at high temperature or a specific objective, the compositions of the PTC material layer may totally or partially use crystalline polymer with high melting point; e.g., polyvinylidene fluoride (PVDF), polyvinyl fluoride (PVF), polytetrafluoroethylene (PTFE), or polychlorotrifluoro-ethylene (PCTFE).

The above crystalline polymers can also comprise a functional group such as an acidic group, an acid anhydride group, a halide group, an amine group, an unsaturated group, an epoxide group, an alcohol group, an amide group, a metallic ion, an ester group, and acrylate group, or a salt group. In addition, an antioxidant, a cross-linking agent, a flame retardant, a water repellent, or an arc-controlling agent can be added into the PTC material layer to improve the material polarity, electric property, mechanical bonding property or other properties such as waterproofing, high-temperature resistance, cross-linking, and oxidation resistance.

The conductive filler may comprise carbon black, metal powder or conductive ceramic powder. If the conductive filler is a metal powder, it could be nickel, cobalt, copper, iron, tin, lead, silver, gold, platinum, or an alloy thereof. If the conductive filler is a conductive ceramic powder, it could be titanium carbide (TiC), tungsten carbide (WC), vanadium carbide (VC), zirconium carbide (ZrC), niobium carbide (NbC), tantalum carbide (TaC), molybdenum carbide (MoC), hafnium carbide (HfC), titanium boride ($TiB_2$), vanadium boride ($VB_2$), zirconium boride ($ZrB_2$), niobium boride ($NbB_2$), molybdenum boride ($MoB_2$), hafnium boride ($HfB_2$), or zirconium nitride (ZrN). The conductive filler may be mixture, alloy, solid solution or core-shell structure of the aforesaid metal powders or conductive ceramic fillers.

The metal powder or the conductive ceramic powder used in the present application could exhibit various types, e.g., spherical, cubic, flake, polygonal, spiky, rod, coral, nodular, staphylococcus, mushroom or filament type, and has aspect ratio between 1 and 1000. The conductive filler may be of high structure or low structure. In general, conductive filler with high structure can improve the resistance repeatability of PTC material, and conductive filler with low structure can improve the voltage endurance of PTC material.

The PTC material layer 10 may further comprise a non-conductive filler to increase voltage endurance. The non-conductive filler of the present invention is selected from: (1) an inorganic compound with the effects of flame retardant and anti-arcing; for example, zinc oxide, antimony oxide, aluminum oxide, silicon oxide, calcium carbonate, boron nitride, aluminum nitride, magnesium sulfate and barium sulfate and (2) an inorganic compound with a hydroxyl group; for example, magnesium hydroxide, aluminum hydroxide, calcium hydroxide, and barium hydroxide. The non-conductive filler of organic compound is capable of decreasing resistance jump.

The conductive layers 11*a* and 11*b* may be metal foils such as copper foils, nickel foils or nickel-plated copper foils. The conductive layers 11*a* and 11*b* may comprise conductive material or conductive composite material formed by electroplating, electrolysis, deposition or film-thickening process.

The connecting conductors 12, 12', 12*a* and 12*a*' are usually made of metal, and can be in the shape of cylinder, semicircular cylinder, elliptic cylinder, semi-elliptic cylinder, plane or sheet. The connecting conductor 12, 12', 12*a* or 12*a*' can be formed in a via, a blind via, or wraps around a full sidewall surface or a part of the sidewall surface, so as to form a conductive through hole, a conductive blind hole or a conductive side surface. As to the SMD over-current protection device having single-side electrode, the most upper conductive layer on the PTC material layer can be fully exposed or only covered by a thin insulating layer such as insulating paint or text ink.

The insulating layers 15 may be composite material comprising epoxy resin and glass fiber, which can be adhesive for jointing the PTC material layers 10 and the conductive layers. In addition to epoxy resin, other insulating adhesives like nylon, polyvinylacetate, polyester or polymide can be used alternatively. The insulating layers 60 may be acrylic resins subjected to thermal curing or UV-light curing.

Except the over-current protection devices shown in FIGS. 1 and 5 are of a single-side electrode, others have upper-and-lower electrodes (double-side electrodes). In terms of the inner and outer of the devices, the conductive layers 11*a* and 11*b* on the PTC material layer 10 are viewed inner circuit, whereas the electrodes 13 and 13' are outer circuits. The over-current protection device of the present application is a laminated structure containing the PTC material layer, the inner conductive layers, the insulating layers and the outer electrode layers. At the melting point, the CTE of the crystalline polymer is larger than about 5000 ppm/K. However, the CTE of the copper foil or nickel-plated copper foil is about 17 ppm/K, and the CTE of the nickel foil is about 13 ppm/K, both are much smaller than that of the crystalline polymer. Therefore, the PTC material layer 10 has a CTE more than 100 times, or more than 200 times or 250 times, the CTE of the metal layers attached thereto. The CTE of the PTC material layer 10 is usually less than 800 or 1000 times the CTE of the metal foil. In case the conductive layers on the PTC material layer is rigid or have superior mechanical strength, the adhesion between the PTC material layer and the conductive layers can restrict or mitigate the expansion of the PTC material layer. Therefore, it is advantageous to volume recovery of the PTC material, resulting in lower resistance jump and better resistance repeatability.

The over-current protection device shown in FIG. 2 is exemplified for testing in which compare example 1 (Comp. 1) and embodiment 1 (Em. 1) use the same structure and material but different thickness of the conductive layers. Comp. 2 vs. Em. 2, and Comp. 3 vs. Em. 3 are other comparison sets in terms of different thicknesses of the conductive layers.

Ri is initial resistances of the over-current protection devices. R1, R2 and R3 are the resistances measured after one hour from a first trip, the to resistances measured after one hour from a second trip and the resistances measured after one hour from a third trip, respectively. The test result of resistances and the resistance jump ratios R3/Ri are shown in Table 1, in which HDPE is high density polyethylene, and LDPE is low density polyethylene. The conductive filler uses tungsten carbide.

TABLE 1

| | Comp. 1 | Em. 1 | Comp. 2 | Em. 2 | Comp. 3 | Em. 3 |
|---|---|---|---|---|---|---|
| Crystalline polymer (weight ratio) | HDPE: LDPE = 100:0 | HDPE: LDPE = 100:0 | HDPE: LDPE = 90:10 | HDPE: LDPE = 90:10 | HDPE: LDPE = 80:20 | HDPE: LDPE = 80:20 |
| Crystalline polymer (wt %) | 7% | 7% | 7.5% | 7.5% | 8% | 8% |
| Conductive filler | WC | WC | WC | WC | WC | WC |
| Conductive filler (wt %) | 93% | 93% | 92.5% | 92.5% | 92% | 92% |
| Conductive layer | Copper foil | Copper foil | Copper foil | Copper foil | Copper foil | Copper foil |
| Thickness of over-current protection device (mm) | 0.5 | 0.6 | 0.51 | 0.66 | 0.48 | 0.69 |
| Thickness of conductive layer (μm) | 35 | 80 | 34 | 105 | 35 | 140 |
| Ri (mΩ) | 9.81 | 11.45 | 7.19 | 7.86 | 7.61 | 8.82 |
| R1 (mΩ) | 15.10 | 11.67 | 9.08 | 7.36 | 10.43 | 9.43 |
| R2 (mΩ) | 14.41 | 11.21 | 9.19 | 7.54 | 10.49 | 9.39 |
| R3 (mΩ) | 15.68 | 12.72 | 10.27 | 8.83 | 11.47 | 10.76 |
| R3/R1 | 1.6 | 1.11 | 1.43 | 1.12 | 1.51 | 1.22 |

All the thicknesses of the conductive layers of Comp. 1-3 are equal to or less than 35 μm, and their R3/Ri are greater than 1.42. The thicknesses of the conductive layers of Em. 1-3 are equal to or greater than 38 μm, and their R3/Ri are less than 1.4, or less than 1.35, 1.3 or 1.25 in particular. It is ideal in case the resistance R3 returns to initial resistance Ri, i.e., R3/Ri=1. In practice, R3/Ri is greater than 1, and is preferably close to 1. The thickness of the conductive layer is about 38-200 μm or 40-200 μm, or in the range of 50-150 μm in particular. Also, the thickness of the conductive layer may be 80, 100 or 120 μm.

According to the present application, the thickness of the PTC material layer is usually in the range of 130 to 930 μm, and the thickness of the conductive layer is about 38-200 μm. Some embodiments of the PTC layer attached with two conductive layers are shown in Table 2. It can be seen that the ratio of the thickness of the PTC material layer to the thickness of the two conductive layers is ranging from 0.3 to 12.5, and preferably in the range from 0.33 to 8.

TABLE 2

| Thickness of PTC layer (A) | Thickness of two conductive layers (B) | A/B |
|---|---|---|
| 130 μm | 76 μm | 1.71 |
| 130 μm | 400 μm | 0.33 |
| 340 μm | 76 μm | 4.47 |
| 340 μm | 400 μm | 0.85 |
| 530 μm | 76 μm | 6.97 |
| 530 μm | 400 μm | 1.33 |
| 930 μm | 76 μm | 12.24 |
| 930 μm | 400 μm | 2.33 |

In summary, the present application discloses a surface-mountable over-current protection device comprising at least one PTC material layer 10, a first conductive layer 11*a*, a second conductive layer 11*b*, a first electrode 13, a second electrode 13' and at least one insulating layer 15. The PTC material layer 10 has opposite first and second planar surfaces, and comprises crystalline polymer and conductive filler dispersed therein. The first conductive layer 11*a* is disposed on the first planar surface, and the second conductive layer 11*b* is disposed on the second planar surface. In other words, the PTC material layer 10 is disposed between the first and second conductive layers 11*a* and 11*b* to form a PTC device. The first electrode 13 electrically connects to the first conductive layer 11*a*, whereas the second electrode 13' electrically connects to the second conductive layer 11*b*. The insulating layer 15 is disposed between the first and second electrodes 13 and 13' to electrically isolate the first electrode 13 from the second electrode 13'. The crystalline polymer has a melting temperature at which the CTE of the crystalline polymer is larger than 100 times of the CTE of first and/or second conductive layer. At least one of the first and second conductive layers has a thickness sufficient to obtain a resistance jump R3/Ri of the over-current protection device less than 1.4, where Ri is an initial resistance, and R3 is a resistance after tripping three times.

The over-current protection device may further comprise a first connecting conductor 12 or 12*a* and a second connecting conductor 12' or 12*a*'. The first connecting conductor 12 or 12*a* may be a conductive through hole, a conductive blind hole or a conductive side surface extending vertically to connect the first electrode 13 and the first conductive layer 11*a*. The second connecting conductor 12' or 12*a*' may be a conductive through hole, a conductive blind hole or a conductive side surface extending vertically to connect the second electrode 13' and the second conductive layer 11*b*.

In comparison with the known over-current protection device, the present application overcomes the resistance jump issue by using thicker conductive layers, thereby resistance jump R3/Ri can be less than 1.4.

The above-described embodiments of the present invention are intended to be illustrative only. Numerous alternative embodiments may be devised by persons skilled in the art without departing from the scope of the following claims.

What is claimed is:

1. A surface-mountable over-current protection device, comprising:

at least one PTC material layer having opposite first and second planar surfaces, and comprising crystalline polymer and conductive filler dispersed therein;

a first conductive layer disposed on the first surface;

a second conductive layer disposed on the second surface;

a first electrode electrically connecting to the first conductive layer;

a second electrode electrically connecting to the second conductive layer; and at least one insulating layer disposed between the first and second electrodes to electrically isolate the first electrode from the second electrode;

wherein the crystalline polymer has a melting temperature at which a CTE of the crystalline polymer is larger than 100 times a CTE of the first or second conductive layer, and at least one of the first and second conductive layers has a thickness sufficient to obtain a resistance jump R3/Ri of the surface-mountable over-current protection device less than 1.4, where Ri is an initial resistance, and R3 is a resistance after tripping three times.

2. The surface-mountable over-current protection device of claim 1, wherein at least of the first and second conductive layers has a thickness ranging from 38 to 200 μm.

3. The surface-mountable over-current protection device of claim 1, wherein a ratio of a thickness of the PTC material layer to a thickness of the first and second conductive layers is in a range of 0.3 to 12.5.

4. The surface-mountable over-current protection device of claim 1, wherein the crystalline polymer comprises high-density polyethylene, medium-density polyethylene, low-density polyethylene, polyethylene wax, vinyl polymer, polypropylene, polyvinyl chlorine, polyvinyl fluoride, copolymer of ethylene and acrylic acid, copolymer of ethylene and acrylic resin, copolymer of olefin monomer and vinyl alcohol monomer, or the combination thereof.

5. The surface-mountable over-current protection device of claim 1, wherein the conductive filler comprises carbon black, nickel, cobalt, copper, iron, tin, lead, silver, gold, platinum, titanium carbide, tungsten carbide, vanadium carbide, zirconium carbide, niobium carbide, tantalum carbide, molybdenum carbide, hafnium carbide, titanium boride, vanadium boride, zirconium boride, niobium boride, molybdenum carbide, hafnium carbide, zirconium nitride, or the mixture, alloy, solid solution or core-shell thereof.

6. The surface-mountable over-current protection device of claim 1, wherein the PTC material layer further comprises non-conductive filler selected from the group consisting of zinc oxide, antimony oxide, aluminum oxide, silicon oxide, calcium carbonate, boron nitride, aluminum nitride, magnesium sulfate, barium sulfate, magnesium hydroxide, aluminum hydroxide, calcium hydroxide, barium hydroxide or the combination thereof.

7. The surface-mountable over-current protection device of claim 1, wherein the first or second conductive layer is copper foil, nickel foil or nickel-plated copper foil.

8. The surface-mountable over-current protection device of claim 1, wherein the first or second conductive layer comprises conductive material or conductive composite material formed by electroplating, electrolysis, deposition or film-thickening process.

9. The surface-mountable over-current protection device of claim 1, wherein the insulating layer comprises epoxy resin containing glass fiber.

10. The surface-mountable over-current protection device of claim 1, wherein the PTC material layer, the first conductive layer, the second conductive layer, the first electrode and the second electrode layer are laminated, and the first and second conductive layers are inner circuits in comparison with adjacent first and second electrodes.

11. The surface-mountable over-current protection device of claim 1, further comprising a first connecting conductor and a second connecting conductor; the first connecting conductor comprising a conductive through hole, conductive blind hole or a conductive side surface and extending vertically to connect the first electrode and the first conductive layer; the second connecting conductor comprising a conductive through hole, conductive blind hole or a conductive side surface and extending vertically to connect the second electrode and the second conductive layer.

12. The surface-mountable over-current protection device of claim 1, wherein two insulating layers are disposed on the first and second conductive layers.

13. The surface-mountable over-current protection device of claim 12, wherein the first electrode comprises a pair of first electrode layers disposed on the two insulating layers, and the second electrode comprises a pair of second electrode layers disposed on the two insulating layers.

14. A surface-mountable over-current protection device, comprising:

at least one PTC material layer having opposite first and second planar surfaces, and comprising crystalline polymer and conductive filler dispersed therein;

a first conductive layer disposed on the first surface;

a second conductive layer disposed on the second surface;

a first electrode electrically connecting to the first conductive layer;

a second electrode electrically connecting to the second conductive layer; and at least one insulating layer disposed between the first and second electrodes to electrically isolate the first electrode from the second electrode;

wherein the crystalline polymer has a melting temperature at which a CTE of the crystalline polymer is larger than 100 times a CTE of the first or second conductive layer;

wherein at least one of the first and second conductive layers has a thickness ranging from 38 to 200 μm to restrict or mitigate expansion of the PTC material layer effectively.

15. The surface-mountable over-current protection device of claim 14, wherein R3/Ri of the surface-mountable over-current protection device is less than 1.4, where Ri is an initial resistance, and R3 is a resistance after tripping three times.

16. The surface-mountable over-current protection device of claim 14, wherein a ratio of a thickness of the PTC material layer to a thickness of the first and second conductive layers is in a range of 0.3 to 12.5.

* * * * *